US009370708B2

(12) United States Patent
Seguin

(10) Patent No.: US 9,370,708 B2
(45) Date of Patent: Jun. 21, 2016

(54) CURVED SAFETY COMPONENT FOR A SKATING RINK

(76) Inventor: Marc-Andre Seguin, Beaconsfield (CA)

( * ) Notice: Subject to any disclaimer, the term of this patent is extended or adjusted under 35 U.S.C. 154(b) by 64 days.

(21) Appl. No.: 13/416,474

(22) Filed: Mar. 9, 2012

(65) Prior Publication Data

US 2012/0227340 A1 Sep. 13, 2012

Related U.S. Application Data

(60) Provisional application No. 61/452,023, filed on Mar. 11, 2011.

(51) Int. Cl.
*E04B 2/00* (2006.01)
*A63C 19/08* (2006.01)
*A63C 19/10* (2006.01)

(52) U.S. Cl.
CPC ..... *A63C 19/08* (2013.01); *A63C 19/10* (2013.01); *A63C 2019/085* (2013.01)

(58) Field of Classification Search
CPC ..... A63C 19/12; A63C 19/10; E04F 13/06; E04F 19/02; E04F 2013/063; E04F 19/0495; E04F 2019/0454; E04F 19/028; E04F 11/163
USPC ..... 52/247, 282.1, 762, 780, 76, 287.1; 472/92, 94
See application file for complete search history.

(56) References Cited

U.S. PATENT DOCUMENTS 1,620,933 A * 3/1927 Wilcox ..... 52/717.01
3,111,206 A * 11/1963 Borup ..... 52/282.1
3,248,738 A * 5/1966 Morgan ..... 2/462
3,634,925 A * 1/1972 Van Loo ..... 29/458
3,717,968 A * 2/1973 Olsen et al. ..... 52/288.1
3,721,433 A * 3/1973 Sobel ..... 267/140
3,792,559 A * 2/1974 Frommelt et al. ..... 52/173.2
3,844,539 A * 10/1974 Abbott ..... 256/24
3,962,827 A * 6/1976 Chaffee ..... 49/384
4,063,702 A * 12/1977 Wilde et al. ..... 248/345.1
4,104,839 A * 8/1978 Balzer et al. ..... 52/288.1
4,120,130 A * 10/1978 Puschkarski ..... 52/282.5
4,161,853 A * 7/1979 Weiss et al. ..... 52/288.1
4,443,508 A * 4/1984 Mehl ..... 428/122
4,690,383 A * 9/1987 Batcheller ..... 256/24
4,787,366 A * 11/1988 Bell ..... 126/500
4,817,902 A * 4/1989 Mason ..... 248/345.1
4,999,233 A * 3/1991 Probst et al. ..... 428/122
5,149,575 A * 9/1992 Soifer ..... 428/188

(Continued)

OTHER PUBLICATIONS

Office Action from Canadian application No. 2,770,547 dated May 25, 2012.

(Continued)

*Primary Examiner* — Adriana Figueroa
(74) *Attorney, Agent, or Firm* — Woodard Emhardt Moriarty McNett & Henry LLP

(57) ABSTRACT

A safety component for a skating rink. The safety component comprises a body portion connectable to a transparent barrier located above dasher boards of the skating rink, wherein upon impact the body portion is capable of at least partially absorbing impact forces. The safety component further comprises a curved rink-facing surface that provides a substantially convex curved surface facing the skating rink. The curved rink-facing surface has a radius of curvature suitable for redirecting the impact forces away from the convex curved surface.

56 Claims, 7 Drawing Sheets

(56) References Cited

U.S. PATENT DOCUMENTS

| | | | | |
|---|---|---|---|---|
| 5,496,609 | A * | 3/1996 | Michelstein | 428/71 |
| 5,508,078 | A * | 4/1996 | Stalnaker | 428/71 |
| 5,611,384 | A * | 3/1997 | Carter | 160/135 |
| 5,702,090 | A * | 12/1997 | Edgman | 256/19 |
| 5,863,030 | A * | 1/1999 | Kotler et al. | 256/24 |
| 6,019,336 | A * | 2/2000 | Havens | 248/345.1 |
| 6,044,601 | A * | 4/2000 | Chmela et al. | 52/287.1 |
| 6,314,688 | B1 * | 11/2001 | Ford et al. | 52/101 |
| 6,327,864 | B1 * | 12/2001 | Crowe | 62/66 |
| 6,349,517 | B1 * | 2/2002 | Manley et al. | 52/239 |
| 6,357,187 | B1 * | 3/2002 | Haldeman | 52/211 |
| 6,484,472 | B2 * | 11/2002 | Chi | 52/718.02 |
| 6,546,675 | B1 * | 4/2003 | Adderton | 52/71 |
| 6,601,355 | B2 * | 8/2003 | Kreitz et al. | 52/287.1 |
| 6,619,008 | B1 * | 9/2003 | Shivak et al. | 52/282.1 |
| 6,622,434 | B1 * | 9/2003 | Garrett | 52/6 |
| 6,625,950 | B1 * | 9/2003 | Shreiner et al. | 52/718.01 |
| 6,748,716 | B1 * | 6/2004 | Peck et al. | 52/718.04 |
| 6,829,863 | B2 * | 12/2004 | Lovas | 52/211 |
| 7,007,988 | B1 * | 3/2006 | Doyle | 293/102 |
| 7,311,958 | B2 * | 12/2007 | Morris | 428/80 |
| 7,434,790 | B1 * | 10/2008 | Hansen | 256/24 |
| 7,617,650 | B1 * | 11/2009 | Hansen et al. | 52/576 |
| 7,730,677 | B2 * | 6/2010 | Hansen | 52/204.5 |
| 7,802,408 | B2 * | 9/2010 | Asbury | 52/282.4 |
| 8,061,105 | B2 * | 11/2011 | Haga | 52/631 |
| 8,267,262 | B2 * | 9/2012 | Thelwell | 211/183 |
| 8,511,018 | B2 * | 8/2013 | Lawrie et al. | 52/288.1 |
| 8,572,912 | B2 * | 11/2013 | Neuhofer, Jr. | 52/211 |
| 8,795,106 | B2 | 8/2014 | Guertin | |
| 2006/0277853 | A1 * | 12/2006 | Dillon | 52/287.1 |
| 2007/0287548 | A1 * | 12/2007 | Irving et al. | 472/90 |
| 2009/0137329 | A1 | 5/2009 | Palumbo et al. | |
| 2010/0288987 | A1 * | 11/2010 | Irving | 256/25 |

OTHER PUBLICATIONS

SRG Fusion Safety Padding product brochure, Sport Resource Group. [retrieved on Mar. 9, 2012] URL: http://sportresourcegroup.com/wp-content/files_mf/srgfusionsafetypadbrochure.pdf>.

* cited by examiner

CURVED SAFETY COMPONENT FOR A SKATING RINK

CROSS REFERENCE TO RELATED APPLICATIONS

This application claims the benefit under 35 USC §119(e) of U.S. provisional patent application Ser. No. 61/452,023 filed on Mar. 11, 2011. The content of the above-mentioned patent application is incorporated herein by reference.

FIELD OF THE INVENTION

The present invention relates to the field of safety equipment for skating rinks, and more particularly to safety equipment that protects skaters from the sharp edges of the transparent barriers that are located above the dasher boards of the skating rink.

BACKGROUND OF THE INVENTION

Hockey, and particularly professional hockey, is known to be a dangerous sport. The players move around the ice at high speeds and often play with a certain level of physical contact. This physical contact can result in collisions between the players and with the boundaries of the skating rink. These collisions can vary in intensity, and can sometimes present a risk of serious injury to the players.

Skating rinks that are intended for hockey games are generally surrounded by dasher boards that define the boundaries of the ice and keep the puck on the ice. The dasher boards are generally about 40 inches (1 meter) high. Positioned on top of the dasher boards are transparent barriers (such as Plexiglas barriers) that provide a physical barrier between the players and the spectators, while still enabling spectators to view what is happening on the ice.

At various locations around the skating rink, doors are included for providing access to the ice. For example, there is an access door to each of the players' benches, and an access door to each of the two penalty boxes. The access doors to the players' benches are generally formed only from the dasher boards and do not have transparent barriers positioned on top. This allows players to jump right over the access doors onto the ice since there is no transparent barrier preventing them from doing so.

However, the lack of the transparent barriers over the access doors also means that the transparent barriers positioned on either side of the access doors either come to an abrupt end or define a corner where two transparent barriers join at 90 degrees. In either case, a sharp edge is created by these transparent barriers that can present a significant safety risk for players.

A deficiency with traditional skating rink constructions is that where the transparent barriers end prior to each access door, a sharp edge is left unprotected. When a player is pushed or body checked into the edge of a transparent barrier, the impact against this edge can cause serious bodily harm to the player. While in certain circumstances the edge of the transparent barrier is padded, traditional padding has not been found to provide sufficient protection when a player impacts this portion of the barrier.

In light of the above, it can be seen that there is a need in the industry for improved safety equipment for preventing injury to hockey players (and other skaters) from the exposed, or insufficiently protected, edge of the transparent barriers.

SUMMARY OF THE INVENTION

In accordance with a first broad aspect, the present invention provides a safety component for a skating rink. The safety component comprises a body portion connectable to a transparent barrier located above dasher boards of the skating rink, wherein upon impact the body portion is capable of at least partially absorbing impact forces. The safety component further comprises a curved rink-facing surface that provides a substantially convex curved surface facing the skating rink. The curved rink-facing surface has a radius of curvature suitable for redirecting the impact forces away from the convex curved surface.

In accordance with a second broad aspect, the present invention provides a safety component for a skating rink that comprises a curved rink-facing surface that defines a substantially convex curved surface facing the skating rink. The curved rink-facing surface is formed of Lexan® and is suitable for redirecting impact forces away from the curved rink-facing surface. The safety component further comprises a first edge portion connectable to a transparent barrier located above dasher boards of the skating rink.

In accordance with a third broad aspect, the present invention provides a safety component for a skating rink. The safety component comprises a resilient body portion for at least partially absorbing impact forces from an impacting body. The resilient body portion comprises a first rink-facing surface that provides a substantially convex curved surface for redirecting the impact forces away from the convex curved surface and a second curved surface located on an opposite side of the resilient body from the first rink-facing surface. The second curved surface faces away from the skating rink.

In accordance with a fourth broad aspect, the present invention provides a curved safety structure for protection of hockey players on a hockey rink. The curved safety structure is mountable between (i) a transparent barrier above a board delimiting part of the hockey rink and (ii) a player bench providing access to the hockey rink. The curved safety structure comprises a curved outer surface for facing the hockey rink, wherein at least part of the curved outer surface is convex and curves towards the player bench, and an inner surface opposite the curved outer surface. Wherein when a hockey player hits the curved safety structure during play, the curved outer surface is able to redirect the hockey player.

In accordance with a fifth broad aspect, the present invention provides a facility for playing hockey comprising a hockey rink, a transparent barrier above a board delimiting part of the hockey rink, a player bench providing access to the hockey rink and a curved safety structure for protection of hockey players on the hockey rink. The curved safety structure is mountable between the transparent barrier and the player bench, and comprises a curved outer surface for facing the hockey rink, wherein at least part of the curved outer surface is convex and curves towards the player bench and an inner surface opposite the curved outer surface. Wherein, when a hockey player hits the curved safety structure during play, the curved outer surface is able to redirect the hockey player.

These and other aspects and features of the present invention will now become apparent to those of ordinary skill in the art upon review of the following description of specific embodiments of the invention and the accompanying drawings.

Other aspects and features of the present invention will become apparent to those ordinarily skilled in the art upon review of the following description of specific embodiments of the invention in conjunction with the accompanying figures.

DETAILED DESCRIPTION

Figure 1:
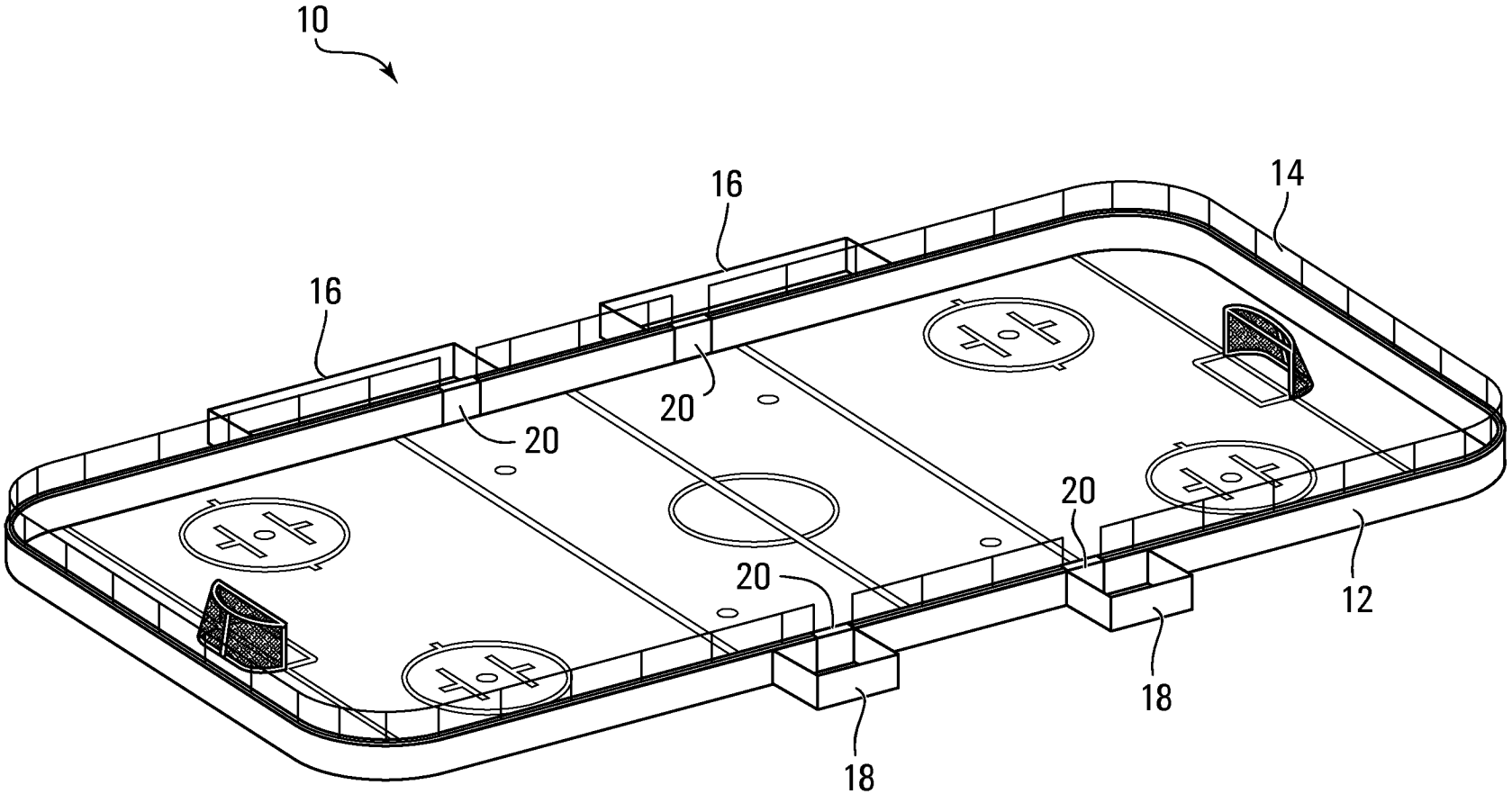
FIG. 1 shows a non-limiting perspective view of a skating rink suitable for incorporating a safety component according to the present invention.

Shown in FIG. 1 is a perspective view of a traditional skating rink 10 suitable for playing hockey. The skating rink 10 comprises dasher boards 12 that surround the ice and define the boundaries of the skating surface. Positioned above the dasher boards 12 are transparent barriers 14 (which can be made of tempered glass, Plexiglas®, Lucite®, Lexan® or any other polycarbonate and/or thermoplastic material, among other possibilities) that provide a physical barrier between the players and the spectators, while still enabling spectators to view what is happening on the ice.

Located around the skating rink 10 are player benches 16, 18. Specifically, located on one side of the skating rink 10 are the players' benches 16 and located on the opposite side of the skating rink 10 are the penalty benches 18. In order to allow the players to access the ice from these benches 16, 18, are access doors 20 that are formed from the dasher boards 12.

Figure 2:
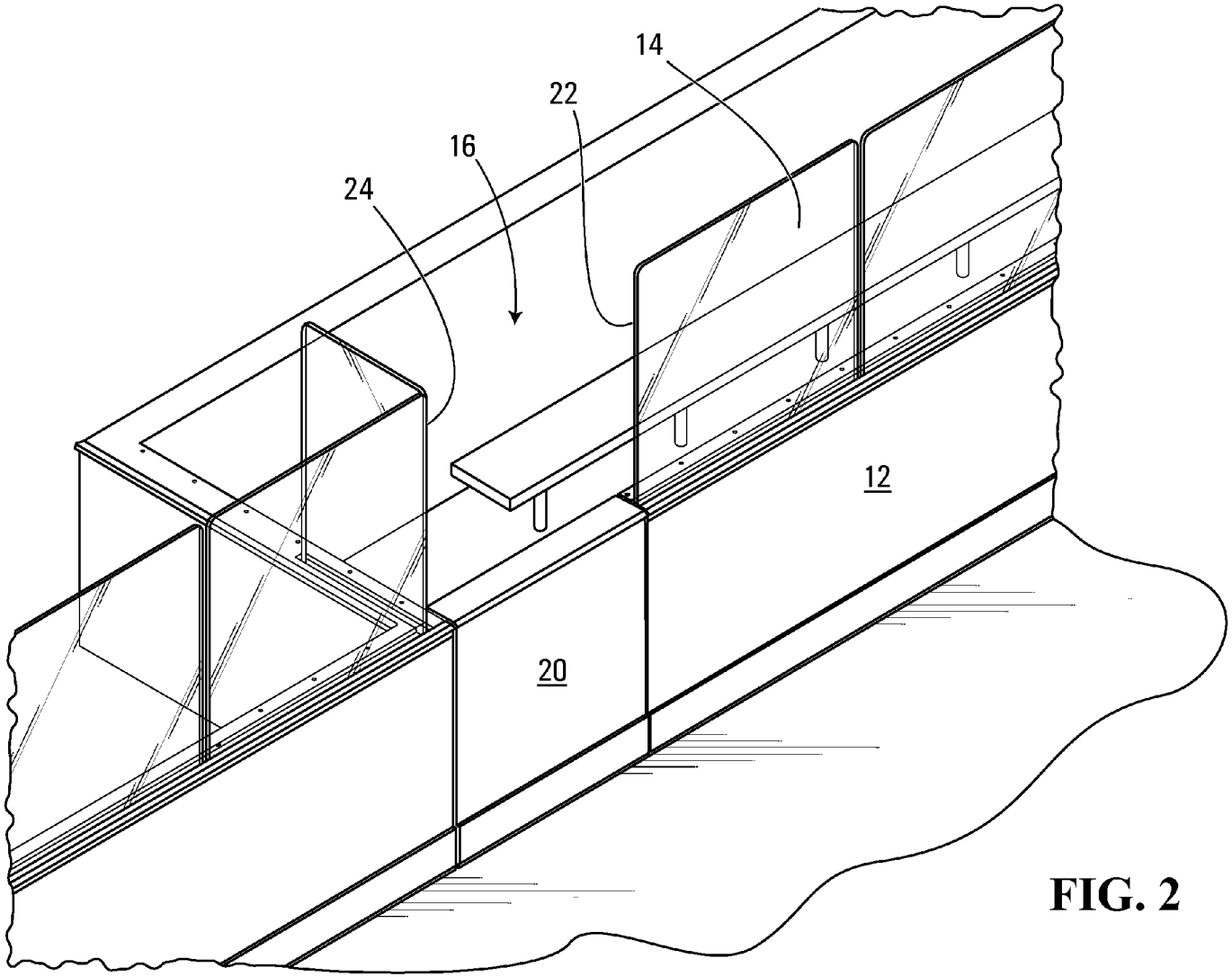
FIG. 2 shows a front perspective view of an access door to players' benches in a traditional skating rink wherein transparent barriers positioned above the dasher boards.

Shown in FIG. 2 is an expanded view of a region of the skating rink 10 that comprises an access door 20 to one of the players' benches 16. Although the term "players' bench" is used herein, this term could also refer to the bench within the penalty box". As shown, the access door 20 is formed from a portion of the dasher boards 12. The access door 20 is hingedly connected to a fixed section of the dasher board 12 such that the access door 20 can swing open and closed. Traditionally, there are no transparent barriers 14 located above the access doors 20, such that players can jump over the access doors 20 instead of having to maneuver them open and closed.

As shown, it is typical that the transparent barriers 14 that are located above the fixed dasher boards 12 on either side of the access door 20 either come to an abrupt end 22 (as shown on the right side of the access door 20) or define a corner 24 where two of the transparent barriers 14 meet (as shown on the left side of the access door 20). In either case, the transparent barriers 14 present a sharp edge that could be hazardous to hockey players, or anyone else skating on the skating rink 10, if they were to collide with the sharp edge.

Figure 3:
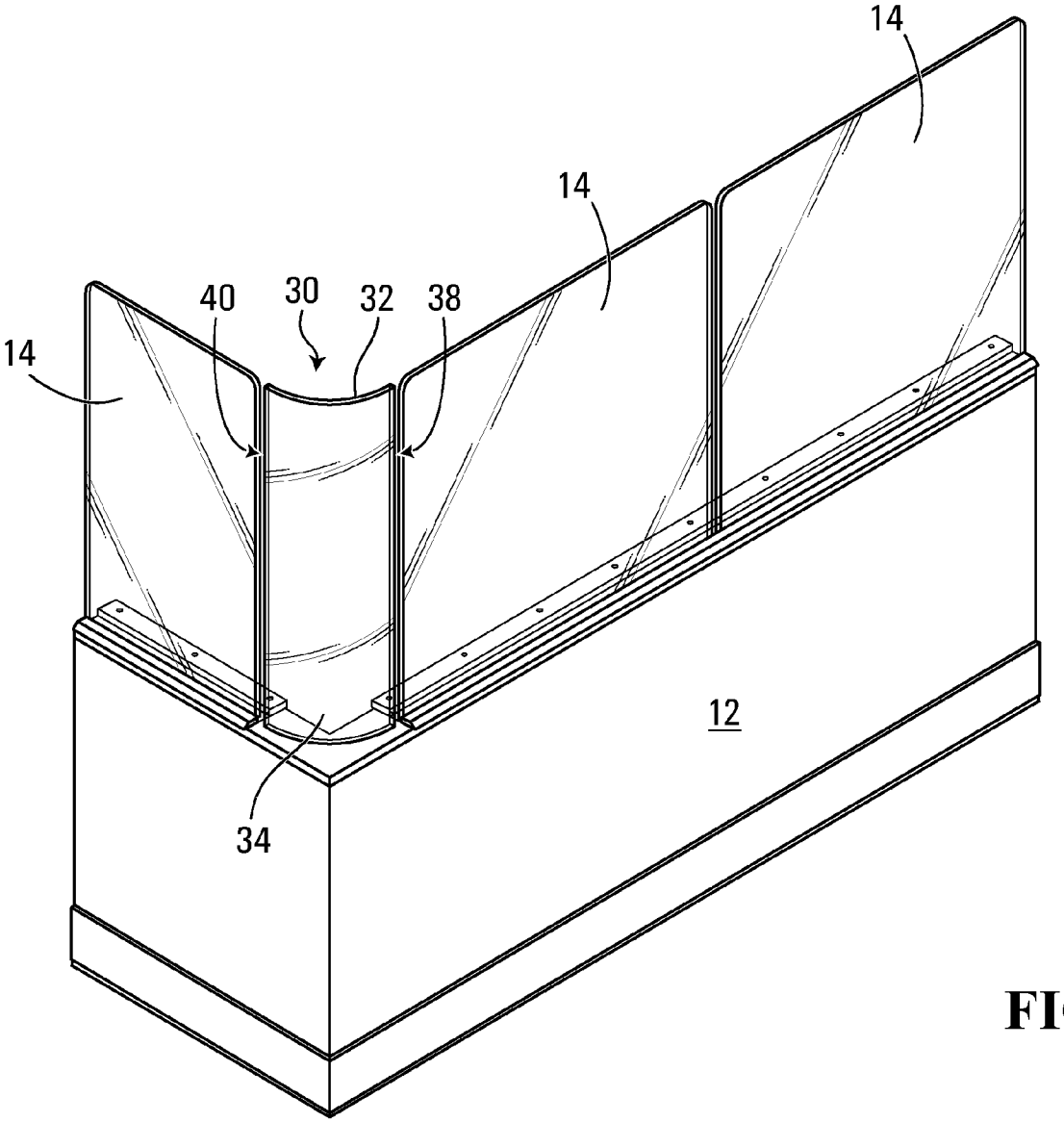
FIG. 3 shows a front perspective view of a first non-limiting example of a safety component according to the present invention that is located above the dasher boards of a skating rink.

Shown in FIG. 3 is a safety component 30 for reducing the occurrence and seriousness of injuries resulting from collisions with such sharp edges of the transparent barriers 14. Different embodiments of safety components in accordance with the present invention will be described in more detail below. However, in each case, the safety components are operative for either covering or replacing any sharp edges created by the transparent barriers, such that when a collision occurs, the safety component is operative for absorbing some of the impact energy received from the collision and redirecting and/or deflecting the impacting object away from the safety component. A more detailed explanation of the construction and functioning of the different embodiments of the safety components according to the present invention will be described below.

Figure 4:
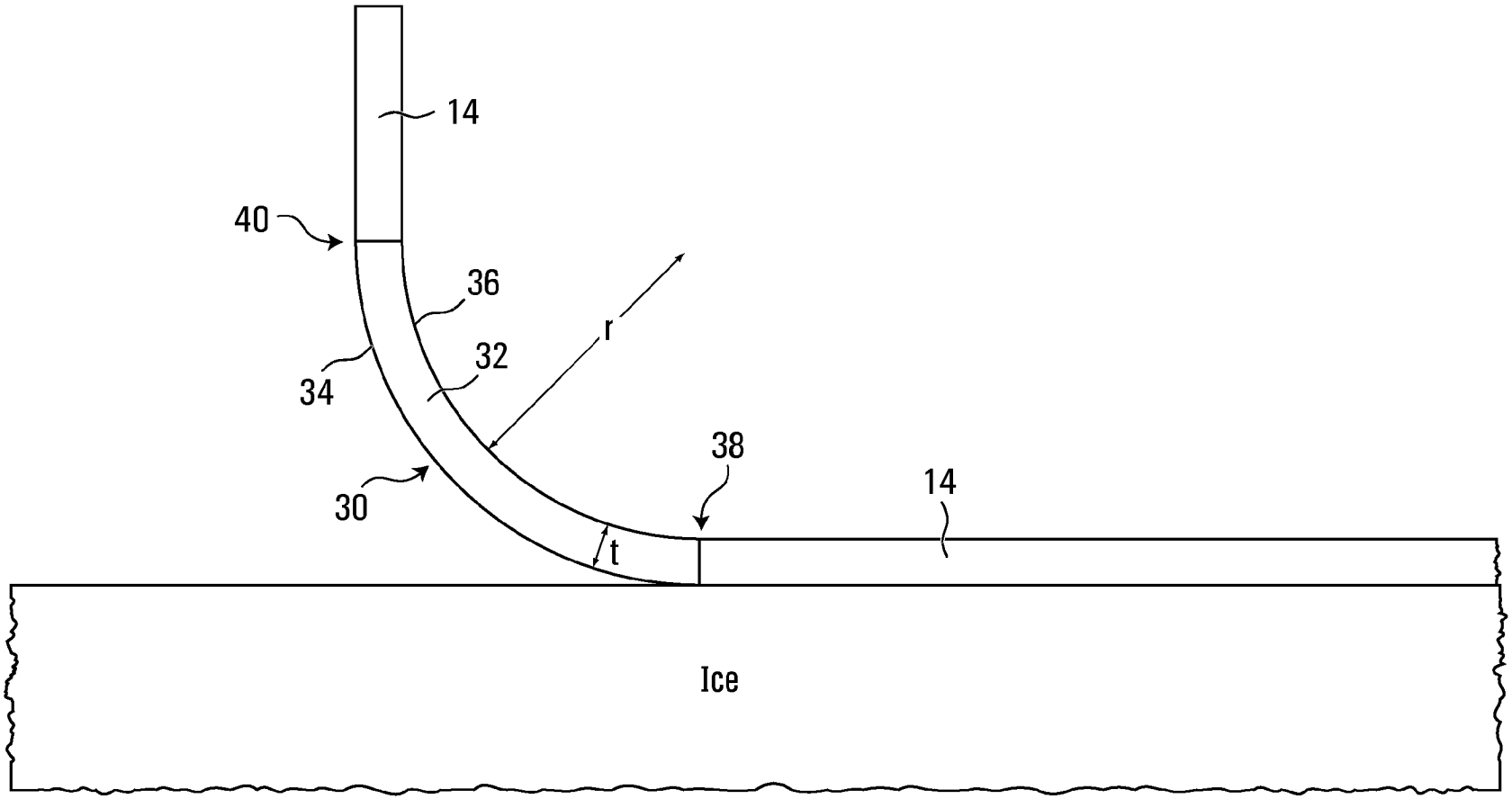
FIG. 4 shows a top plan view of the safety component of FIG. 3.

Shown in FIGS. 3 and 4 is a safety component 30 in accordance with a first non-limiting example of implementation of the present invention. As indicated above, the safety component 30 is operative for reducing the occurrence and seriousness of injuries caused by collisions and impacts with the transparent barriers 14. The safety component 30 is intended to be used as a rounded, end-piece in locations where the transparent barriers 14 would normally come to an abrupt end 22 or form a corner 24 with a sharp edge. In this manner, the safety component 30 effectively replaces a region of the transparent barriers 14 that would traditionally have presented a sharp edge that could have been hazardous to hockey players or other skaters.

As shown, the safety component 30 comprises a body portion 32 and a curved rink-facing surface 34 (a.k.a. the outer surface). At least a portion of the rink-facing surface 34 curves inwards towards the players' benches 16. The body portion 32 of the safety component 30 comprises a first edge portion 38 and a second edge portion 40 that are connectable to the transparent barriers 14 located above the dasher boards 12. In the embodiment shown in FIGS. 3 and 4, both of the first edge portion 38 and the second edge portion 40 are connectable to respective transparent barriers 14, for forming a rounded corner between two transparent barriers 14 that are positioned at an angle in relation to each other. However, it should be appreciated that only the first edge portion 38 may be connected to a transparent barrier 14, such that the second edge portion 40 may be unconnected to anything. In such a case, the second edge portion 40 would not be facing towards the skating rink 10, such that the exposed edge portion 40 would not present a safety hazard for hockey players or other skaters using the skating rink 10. More specifically, the safety component 30 would still present a rounded or curved surface facing the skating rink 10 that would be impacted should one or more of the players/skaters impact this safety component 30.

The first and second edge portions 38, 40 may be connected to the adjacent transparent barriers 14 using any suitable connection technique or device known in the art. For example, the connection may be made via epoxy, glue or some other adhesive material, or the connection may be made by a physical connector that is bolted, riveted or otherwise affixed between the safety component 30 and the transparent barrier 14.

In accordance with a non-limiting example, one of the two edge portions, such as edge portion 38 may be rigidly affixed to its adjacent transparent barrier 14, while the other edge portion, such as edge portion 40, may be connected to its adjacent transparent barrier 14 via a resilient connector element, such as a spring or other compressible component. In such an embodiment, the manner in which the safety component 30 is connected to the dasher boards 14 will help allow the safety component 30 to absorb some of the impact forces of an impacting object, such as when a hockey player hits the safety component. In addition, this manner of connecting the safety component 30 to the transparent barriers 14 will help the safety component 30 to rebound and redirect an impacting object, such as the hockey player, back onto the surface of the skating rink.

The body portion 32 of the safety component 30 is formed of a resilient material that, when impacted, is able to absorb at least some of the impact forces of the impacting object/body. In the non-limiting embodiment shown in FIGS. 3 and 4, the body portion 32 of the safety component 30 is transparent, and may be made of a material such as Plexiglas®, Lucite® or a polycarbonate thermoplastic, such as Lexan®, among other possibilities. The transparency of the body portion 32 allows spectators in the stands to have a clear view of the playing surface of the skating rink 10 without any obstruction. Furthermore, the resiliency of the body portion 32 allows the body portion 32 to move slightly in relation to the dasher boards 12, which helps to facilitate the absorption of impact forces.

In the non-limiting embodiment shown in FIGS. 3 and 4, the curved rink facing surface 34 is a first surface of the body portion 32 and provides a substantially convex surface facing the skating rink 10. The body portion 32 of the safety component 30 comprises two surfaces, namely the curved rink-facing surface 34 and a second curved surface 36 located on the opposite side of the body portion 34. In the embodiment shown, the second curved surface 36 provides a substantially concave surface facing away from the skating rink 10 towards the spectators stands.

The curved rink-facing surface 34 is curved so as to be able to redirect/deflect an impacting object, such as a hockey player, away from the safety component 30, such as back onto the playing surface of the skating rink. Moreover, the curved shape of the rink-facing surface 34 is operative for redirecting/rebounding the impacting object such that the object's impact energy is decomposed and the perpendicular component of the impact force is lessened. This reduction in the impact energy helps to reduce the likelihood of serious injury resulting from a collision with the safety component 30.

In accordance with the present invention, the curved rink-facing surface 34 is a low-friction surface for facilitating the deflection of the impact forces away from the safety component 30, such that there is a portion of the impact energy that is unabsorbed by the safety component 30. The low-friction surface may be a surface formed from the same material as the body portion 32, such as a Plexiglas® surface or a Lexan® surface, among other possibilities. Alternatively, the low-friction surface may be formed via a low-friction coating applied to the body portion 32 of the safety component 30. In either case, the low-friction rink-facing surface 34 has a coefficient of friction that is low enough to prevent the impacting object/body from sticking to the surface, which could hinder the safety component's ability to redirect the impacting object/hockey player back into the skating rink 10.

As described above, the safety component 30 has a convex rink-facing surface 34 and an opposite concave surface 36 facing away from the skating rink 10. In a first non-limiting embodiment, the safety component 30 has a relatively uniform thickness "t" between the first edge portion 38 and the second edge portion 40. In accordance with a non-limiting example, the safety component 30 may have a thickness in the order of approximately 0.1-0.5 inches, or greater.

Alternatively, the thickness "t" of the safety component may vary between the first edge portion 38 and the second edge portion 40. For example, the thickness "t" of the safety component may be greater at a middle region located between the first and second edge portions 38, 40, since this middle region is more likely to be the region that is impacted by a colliding object/body. Alternatively, the middle region may be less thick than the first and second edge portions 38, 40 to allow for greater resiliency in that region to absorb impact forces and redirect an impacting object away from the safety component 30.

As shown in FIG. 3, the height of the safety component 30 will generally be equivalent to the height of the transparent barriers 14, such that there is consistency in the height of the barriers positioned above the dasher boards 12. However, the safety component 30 can have any height that is suitable for providing protection to the players/skaters using the skating rink 10.

As shown in FIG. 4, the safety component 30 may have a constant radius of curvature "r" between the first and second edge portions 38, 40. In accordance with a non-limiting example, the radius of curvature "r" of the safety component 30 is greater than 6 inches, and may be between 6 to 12 inches, among other possibilities. Alternatively, the radius of curvature "r" of the safety component 30 may vary from the first edge portion 38 to the second edge portion 40. For example, the radius of curvature from the first edge portion 38 to a mid-way point or a three-quarter point, may be greater than the radius of curvature from the mid-way point or three-quarter point, to the second edge portion 40. As such, the "tightness" of the curve would increase from the first edge portion 38 towards the second edge portion 40. In either case, the radius of curvature of the curved rink-facing surface 34 is suitable for redirecting the impact forces away from the convex curved surface.

In accordance with the present invention, the resiliency of the body portion 32 of the safety component 30 is provided both by the choice of material used to form the body portion 32, the manner in which it is mounted to the transparent barriers 14/dasher boards 12 as well as the curved shape of the body portion 32. More specifically, when a colliding object impacts the curved body portion 32 of the safety component 30, the safety component 30 is able to absorb some of the impacting forces from the object, via at least one of the material resiliency, the compressible manner in which it is mounted to the transparent barriers 14 and the shape of the rink-facing surface 34. In addition, the shape and material of the curved rink-facing surface 34 helps to redirect the impacting object back towards the skating surface. In some cases, the safety component may move slightly (compress) in relation to the dasher boards 12, and then retake its initial form, which helps to both absorb some of the impact forces and redirect the remaining impact forces away from the safety component 30. Therefore, in order to reduce the force of the impact felt by a hockey player, or other impacting object, the safety component 30 is operative for absorbing some of the impact forces (but not all) and then redirecting/rebounding the impact object away from the safety component 30 such that the remaining impact forces are not absorbed by the safety component 30.

Figure 5:
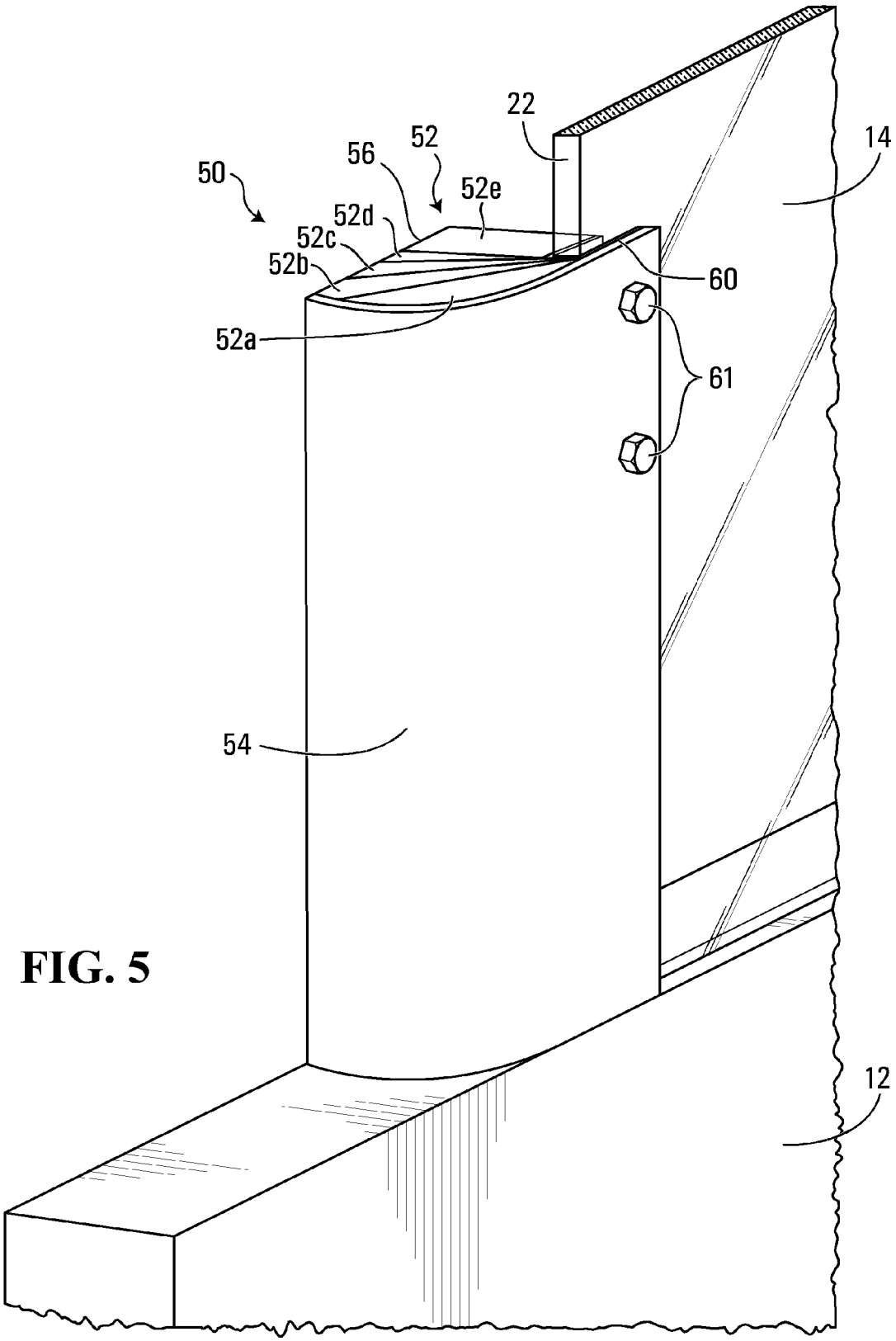
FIG. 5 shows a front perspective view of a second non-limiting example of a safety component according to the present invention connected to a transparent barrier above the dasher boards of a skating rink.
Figure 6:
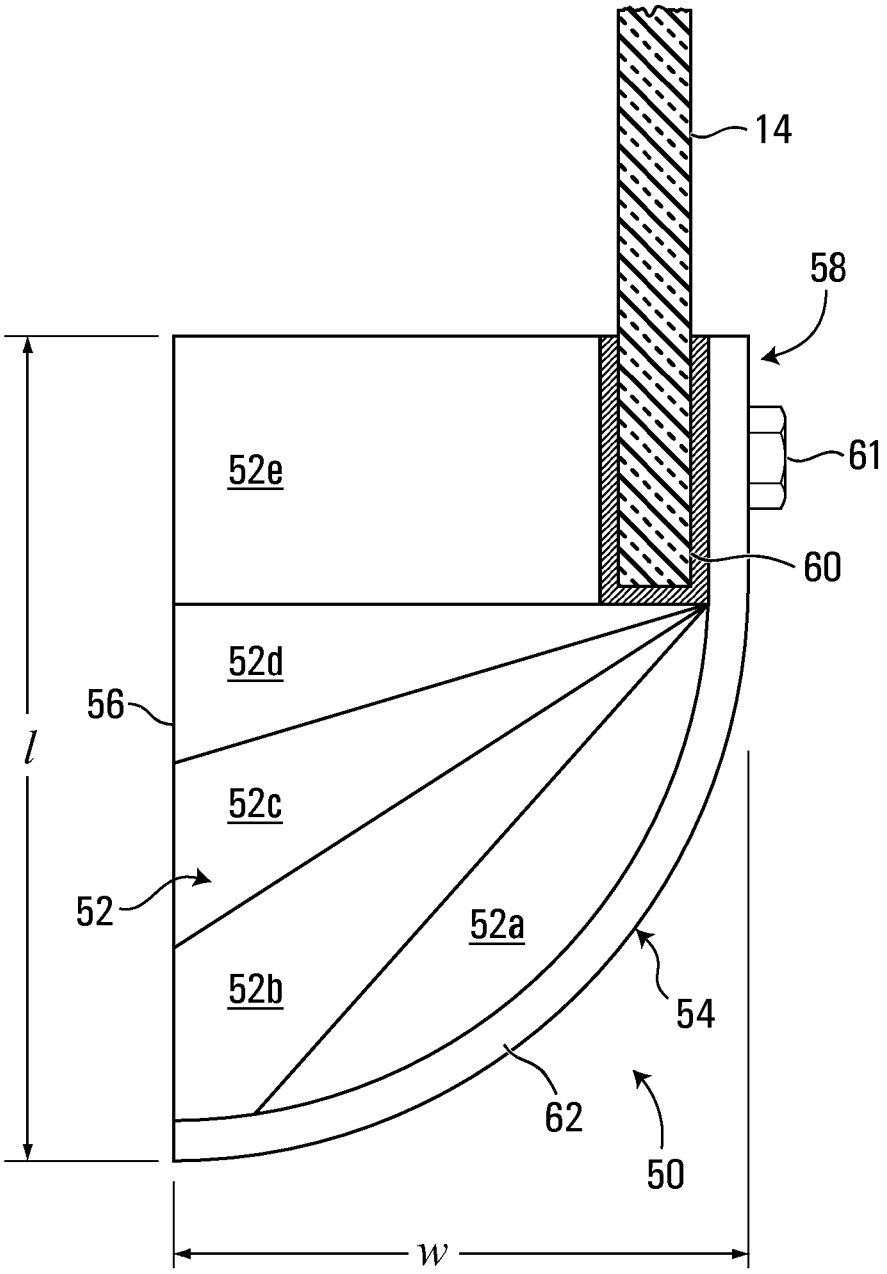
FIG. 6 shows a top plan view of the safety component and transparent barrier of FIG. 5.

Shown in FIGS. 5 and 6 is a safety component 50 in accordance with a second non-limiting example of implementation of the present invention for reducing the occurrence and seriousness of injuries caused by the sharp edges of the transparent barriers 14. The safety component 50 is intended to be attached to an exposed edge 22 of the transparent barriers 14. In this manner, the safety component 50 effectively covers the region of the transparent barriers 14 that would traditionally have presented a sharp edge that could have been hazardous to hockey players or other skaters.

Although FIG. 5 shows the safety component 50 connected to an exposed edge 22 of a transparent barrier 14, safety component 50 could also be configured to be attached to an exposed corner 24 formed by two transparent barriers 14 positioned at an angle in relation to each other.

As shown, the safety component 50 comprises a body portion 52 and a curved rink-facing surface 54 that together are able to absorb some of the impact forces from an impacting object/body and redirect the impacting object away from the edge 22 of the transparent barrier 14.

The body portion 52 of the safety component 50 is formed of a resilient material that, when impacted, is able to absorb at least some of the impact forces. The resiliency of the body portion 32 further allows the body portion 32 to move slightly in relation to the dasher boards 12 to facilitate the absorption of impact forces.

The resilient body portion 52 may be made of any material or structure that is capable of performing impact absorption. For example, in accordance with a first non-limiting embodiment, the resilient body portion 52 may be made of a foam material, such as a foamed polyurethane, polystyrene or rubber, among other possibilities. In an alternative embodiment, the resilient body portion 52 may be made of one or more air bladders that have air holes of consistent or varying diameters that are able to release air at varying rates upon impact. In yet a further alternative embodiment, the resilient body portion 52 may be made of one or more water displacement bladders for providing hydraulic impact absorption.

The resilient body portion 52 may have a constant density and resiliency throughout. For example, the resilient body portion 52 may be made of a uniform piece of material, or a single air bladder, among other possibilities. However, in an alternative embodiment, as shown in FIGS. 5 and 6, the resilient body portion 32 may be made of a plurality of sections 52*a-e* of varying density and/or resiliency. The sections 52*a-e* may provide a gradation of densities that move from less dense to more dense in a direction that extends away from the rink-facing surface 54. For example, the section 52*a* that is closest to the rink-facing surface 54 may have the softest density and the section 52*e* that is farthest away from the rink-facing surface 54 may have the hardest density. Although different discrete sections 52*a-e* are shown in the Figures, the resilient body portion 52 may be formed of a single piece of foam that provides a gradation in density in a direction moving away from the curved rink-facing surface 54.

The safety component 50 further comprises a first edge portion 58 that is connectable to a transparent barrier 14 above the dasher boards 12. In the non-limiting embodiment shown in FIGS. 5 and 6, the first edge portion 58 comprises a slot 60 for receiving the edge 22 of the transparent barrier 14. Once the slot 60 of the safety component 50 has been placed on the edge 22 of the transparent barrier 14, the safety component 50 can be connected to the transparent barrier 14 via any suitable connection mechanism known in the art. In the non-limiting embodiment shown, bolts 61 are used to connect the safety component 50 to the transparent barrier 14. However, other connection mechanisms such as adhesive, epoxy and/or rivets could be used among other possibilities known in the art.

As mentioned above, the safety component 50 comprises a curved rink-facing surface 54 that provides a substantially convex surface facing the skating rink 10, and that curves towards a players' bench. The curved rink-facing surface 14 provides an impact deflection/rebound surface that is able to redirect an impacting object away from the safety component 50 for minimizing the impact felt by the head or neck of a player/skater who may come into contact with the safety component 50. More specifically, the convex rink-facing surface 34 is curved so as to be able to redirect/deflect an impacting object/hockey player away from the safety component 50 and back into the playing surface of the skating rink 10. The curved shape of the rink-facing surface 54 redirects the impacting object such that the object's impact energy is decomposed and the perpendicular component of the impact force is lessened. This reduction in the perpendicular component of the impact energy helps to reduce the likelihood of serious injury resulting from a collision with the safety component 50.

The curved rink-facing surface 54 may be formed from a surface of the resilient body portion 52. For example, the curved rink-facing surface 54 may be an outer surface of the foam padding that forms the body portion 52, or an outer surface of an air or water bladder that forms the body portion 52. However, in an alternative embodiment, at least a portion of the curved rink-facing surface 54 is formed from an additional layer of material 62 that is applied to the curved surface of the resilient body portion 52. The additional layer of material 62 may be any type of material having the properties desired. For example, the additional layer of material 62 may be Lexan® (a polycarbonate thermoplastic), polyurethane or rubber, among other possibilities.

In accordance with the present invention, the curved rink-facing surface 54 is a low-friction surface for facilitating the redirection of the impact forces away from the safety component 50, such that there is a portion of the impact energy that is unabsorbed by the safety component 50. As indicated above, the low-friction surface may be a surface formed from the same material as the body portion 52, or may be formed via a separate sheet of material 62. In yet a further alternative, the curved rink-facing surface may have a low-friction coating applied thereto in order to reduce the surface friction of either the body portion 52 or the sheet of material 62. The low-friction surface helps to prevent a player's face, helmet or neck from sticking to the rink facing surface 54, thereby facilitating the deflection and redirection of the impacting object/body.

In accordance with the embodiment shown in FIGS. 5 and 6, the curved rink-facing surface 54 together with the resilient body portion 52 can compress (thereby absorbing some of the impact forces from a collision), and then deflect/rebound the impacting object away from the safety component 50. In this manner, the safety component 50 acts as a type of resilient spring that absorbs some of the impacting energy and then pushes the impacting object/body away. This resiliency of the curved rink-facing surface 54 and the body portion 52 further enables the safety component 50 to rebound to its original shape following impact.

The dimensions of the safety component 50 may vary while still keeping within the spirit of the present invention. In accordance with a non-limiting embodiment, the safety component 50 has a length "l" of greater than 4 inches, such as between 4-7 inches for example, and a width "w" of grater than 3, such as between 3-6 inches for example. These values are given strictly for the purposes of example, and are not intended to limit the scope of the invention in any way.

In the non-limiting embodiment shown in FIG. 6, the rink-facing surface 54 of the safety component 50 has a convex-shaped curve, and the opposite surface 56 that faces the stands is flat. However, in an alternative embodiment, the surface 56 on the opposite side of the body portion 52 that faces away from the skating rink 10 can be curved. For example, the surface 56 may present either a convex or a concave curved surface that faces away from the skating rink 10.

Referring back to the curved rink-facing surface 54, this surface may have a radius of curvature that is constant, or that increases or decreases in a direction moving away from the first edge portion 58. In accordance with a non-limiting embodiment, the curved rink-facing surface has a radius of curvature of greater than 6 inches, such as between 6-12 inches, among other possibilities.

Furthermore, the safety component 30 may have a height that is substantially equivalent to the height of the transparent barriers 14, such that there is consistency in the height of the barriers positioned above the dasher boards 12. However, the safety component 50 can have any height that is suitable for providing protection to the players/skaters using the skating rink 10. As shown in FIG. 5, the safety component 50 may have a shorter height, such that a plurality of safety components 50 can be stacked about edge 22 of the transparent barriers 14 in order to cover the entire edge 22 of the transparent barrier 14.

Figure 7A:
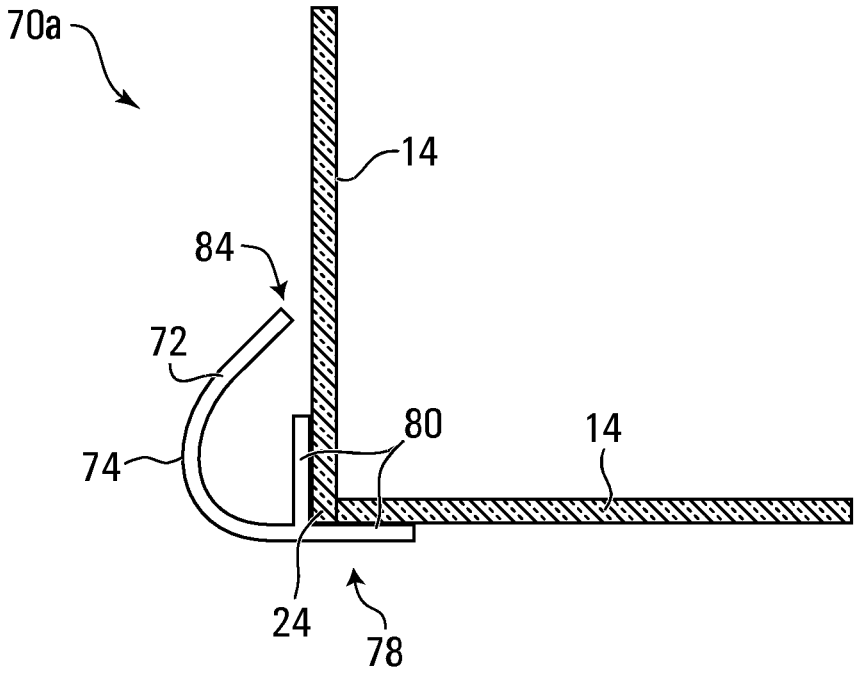
FIG. 7A shows a top plan view of a third non-limiting example of a safety component according to the present invention connected to a transparent barrier.
Figure 7B:
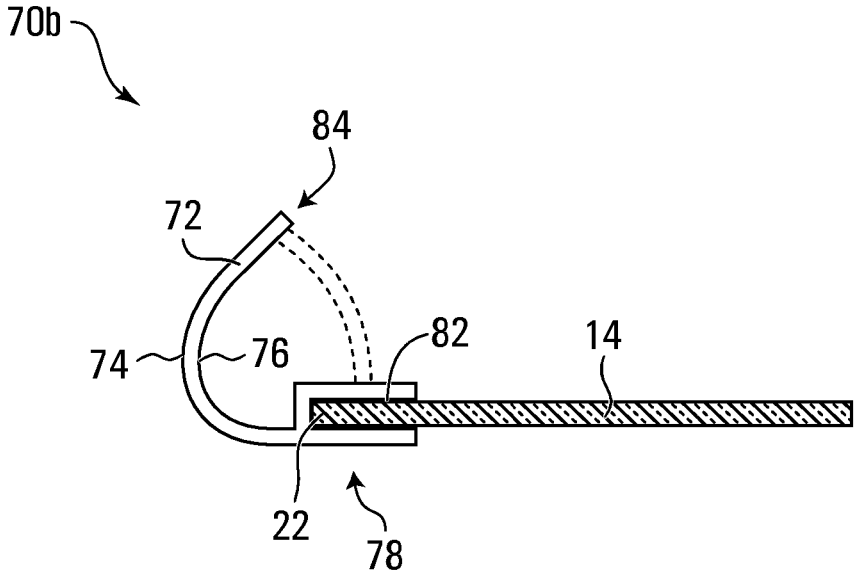
FIG. 7B shows a top plan view of a fourth non-limiting example of a safety component according to the present invention connected to a transparent barrier.

Shown in FIG. 7A is a safety component 70*a* in accordance with a third non-limiting example of implementation, and shown in FIG. 7B is safety component 70*b* in accordance with a fourth non-limiting example of implementation of the present invention. The safety component 70*a* shown in FIG. 7A is suitable for being connected to a corner 24 formed by two transparent barriers 14 that are positioned at an angle in relation to each other, and the safety component 70*b* shown in FIG. 7B is suitable for being connected to an abrupt edge 22 of a transparent barrier 14.

Both safety components 70*a* and 70*b* comprise a body portion 72 and a curved rink-facing surface 74. Together, the body portion 72 and the curved rink-facing surface 74 are able to absorb impact forces from an impacting object/body and redirect/deflect the impacting object/body away from the edge of the transparent barrier(s) 14.

The body portion 72 comprises a first edge portion 78 that is connectable to a transparent barrier 14 above the dasher boards 12. In the non-limiting embodiment shown in FIG. 7A, the first edge portion 78 comprises two arms 80 that are able to be connected to a corner 24 formed by two transparent barriers 14 that are positioned at an angle in relation to each other. In the non-limiting embodiment shown in FIG. 7B, the first edge portion 78 comprises a slot 82 for receiving the edge 22 of a transparent barrier 14. Once the two arms 80 or the slot 82 of the safety components 70*a*, 70*b* have been placed about the edge presented by one or more of the transparent barriers 14, the safety components 70*a*, 70*b* can be connected to the transparent barrier(s) 14 via bolts, adhesive, epoxy and/or rivets, among any other possible attachment mechanisms known in the art.

In the embodiments shown in FIGS. 7A and 7B, only a first edge portion 78 of the safety components 70*a*, 70*b* is connected to the transparent barrier(s) 14, and the second edge portion 84 is unconnected to anything. However, the second edge portion 84 extends away from the skating rink 10, such that the exposed edge portion 84 does not present a safety hazard to hockey players or other skaters using the skating rink 10. It is still a rounded/curved surface 74 that faces the skating rink 10 and that would be impacted upon collision by one or more of the players/skaters.

The body portion 72 of both safety components 70*a*, 70*b* is formed of a resilient material that, when impacted, is able to absorb at least some of the impact forces created by the impacting object/hockey player. The resiliency of the body portion 72, as well as the shape of the body portion 72, further allows the body portion 72 to deflect/redirect an impacting object/hockey player.

The resilient body portion 72 can be made of any material or structure that is capable of performing impact absorption. For example, the resilient body portion 72 may be made of Plexiglas®, Lucite®, a thermoplastic material, or a polycarbonate thermoplastic, such as Lexan®, among other possibilities. The body portion 72 could also be made of rubber. The body portion 72 may be transparent, so as to avoid obstructing the view of spectators in the stands, or alternatively may be made of an opaque material such that players/skaters can quickly identify that there is a safety component 70*a*, 70*b* protecting the transparent barriers 14 on either side of the access doors 20.

In the case of the safety components 70*a*, 70*b*, the shape of the body portion 72 adds to the ability to perform impact absorption from an impacting object/hockey player. More specifically, the safety components 70*a*, 70*b* have a substantially U-shaped cross section, with a first end 78 of the U-shape connected to the transparent barriers 14 and the second end 84 of the U-shape either abutting against a transparent barrier 14 or overhanging a transparent barrier 14. It is therefore the bottom portion (or the side of the bottom portion) of the U-shape that faces the skating rink 10. When a colliding object impacts the bottom portion of the U-shaped safety components 70*a*, 70*b*, this bottom portion is able to compress in relation to the transparent barriers 14 as well as the dasher boards 12, for providing a deflecting, spring-like action. Therefore, in such an embodiment, it is not just the material of the safety components 70*a*, 70*b* that provides resiliency, but also the shape of the body portion 72 and the manner in which the safety components 70*a*, 70*b* are mounted to the transparent barriers 14. The resiliency of the body portion 72 allows the body portion 72 to move slightly in relation to the dasher boards 12, such that a certain level of flexibility is built into the construction of the safety component 30, which helps to facilitate the absorption of impact forces.

As mentioned above, each of the safety components 70*a*, 70*b* comprises a curved rink facing surface 74, at least a part of which may curve towards a players' bench. In the non-limiting embodiments shown, the curved rink-facing surfaces 74 are formed from a first surface of the body portion 72. More specifically, the body portion 72 comprises two surfaces, namely the curved rink-facing surface 74, that provides a substantially convex surface facing the skating rink 10, and a second curved surface 76 located on the opposite side of the body portion 74. In the embodiment shown, the second curved surface 76 provides a substantially concave surface facing away from the skating rink 10, towards the spectators stands.

The convex rink-facing surface 74 is curved so as to be able to redirect an impacting object (or hockey player) away from the safety component and back into the playing surface of the skating rink 10. The curved shape of the rink-facing surface 74 is operative for redirecting the impacting object such that the object's impact energy is decomposed, and the perpendicular component of the force is lessened. This reduction in the perpendicular component of the impact energy helps to reduce the likelihood of serious injury resulting from a collision with the safety component 70*a*, 70*b*.

The curved rink-facing surface 74 is also a low-friction surface for facilitating the deflection of the impact forces away from the safety components 70*a*, 70*b*, such that there is a portion of the impact energy that is unabsorbed by the safety components 70*a*, 70*b*. The low-friction surface may be a surface formed from the same material as the body portion 72, namely a Plexiglas® surface or a Lexan® surface, among other possibilities. Alternatively, the low-friction surface may be formed via a low-friction coating applied to the body portion 72 of the safety components 70*a*, 70*b*.

In the same manner as described above with respect to safety component 30, the safety components 70*a*, 70*b* may have a relatively uniform thickness "t" between the first edge portion 78 and the second edge portion 84, or the thickness "t" may vary between the first edge portion 78 and the second edge portion 84. For example, the thickness "t" of the safety components 70*a*, 70*b* may be greater at a middle region located between the first and second edge portions 78, 84, since this middle region is more likely to be the region that is impacted by a colliding object. Alternatively, the middle region may be less thick than the first and second edge portions 78, 84 to allow for greater resiliency in that region to absorb impact forces.

The height of the safety components 70*a*, 70*b* will generally be equivalent to the height of the transparent barriers 14, such that there is consistency in the height of the barriers positioned above the dasher boards 12. However, the safety components 70*a*, 70*b* can have any height that is suitable for providing protection to the players/skaters using the skating rink 10.

While existing safety components are limited to providing impact absorption, the safety components 30, 50, 70*a* and 70*b* according to the present invention are able to provide both impact absorption and redirection/deflection of the impacting object. This is achieved via the curved nature of the rink-facing surfaces as well as the resiliency of the body portion of the safety components. As such, the impact energy of an impacting object is at least partially absorbed by the safety components, and the impacting object is caused to be redirected away from the edge/corner of the transparent barriers at an angle. Existing safety components do not provide this dual benefit of both impact absorption and deflection/redirection of the impacting object.

As mentioned above, each of the safety components 30, 50, 70*a* and 70*b* has a curved rink-facing surface 34, 54, 74 for redirecting/deflecting an object away from the safety component. Given that at least a portion of the curved rink-facing surface may curve towards a players' bench of the hockey rink, depending on an angle at which an object (such as a puck) impacts the curved rink-facing surface, it is possible that the object is redirected towards the hockey players sitting on the player's bench. This obviously presents a certain safety hazard given that the deflecting object could hit the players sitting on the bench. Therefore, in accordance with a non-limiting embodiment of the present invention, a safety shield such as a "puck blocker" may be installed next to the safety component 30, 50, 70*a* and 70*b* for preventing an impacting object (such as the puck) from hitting a player on the bench. The safety shield may be mounted near the second edge portion 40 of the safety component and extend towards the dasher boards 12. The safety shield could be mounted via a hinge, such that its positioning could be adjusted. As such, the safety shield would be operative to catch or block an impacting object that may be redirected into the player's bench area so as to prevent one or more players from being hit by a badly redirected object. The safety shield may simply be a net or other fabric or plastic screen that can catch or block such an impacting object.

Although the safety components 30, 50, 70*a* and 70*b* described above have been described in the context of a skating rink, it should be appreciated that they may be used as safety components in other fields as well. For example, similar safety components that provide both impact absorption and redirection of the impacting object/body could be used to protect goal posts in soccer and football, for example. The safety components according to the present invention can be used in a variety of different applications without departing from the present invention.

The present invention has been described in considerable detail with reference to certain preferred embodiments thereof However, variations and refinements are possible without departing from the spirit of the invention. The scope of the invention should be limited only by the appended claims and their equivalents.

The invention claimed is:

1. A curved safety structure for protection of hockey players on a hockey rink, the curved safety structure being mounted between (i) a transparent barrier above a board delimiting part of the hockey rink and (ii) a player bench providing access to the hockey rink, the curved safety structure comprising:

a. a curved outer surface facing the hockey rink, at least part of the curved outer surface being convex and curving towards the player bench; and b. an inner surface opposite the curved outer surface;

wherein the curved outer surface is configured such that, when a hockey player hits the curved safety structure during play, the curved outer surface redirects the hockey player.

2. The curved safety structure of claim 1, wherein at least part of the curved outer surface has a radius of curvature of at least six inches.

3. The curved safety structure of claim 2, wherein the radius of curvature is greater than six inches.

4. The curved safety structure of claim 2, wherein the radius of curvature is between six inches and twelve inches.

5. The curved safety structure of claim 1, wherein the curved outer surface comprises a material other than foam.

6. The curved safety structure of claim 1, wherein the curved outer surface comprises polycarbonate.

7. The curved safety structure of claim 6, wherein the polycarbonate comprises Lexan® polycarbonate.

8. The curved safety structure of claim 1, wherein the inner surface is a curved inner surface.

9. The curved safety structure of claim 8, wherein at least part of the curved inner surface is concave.

10. The curved safety structure of claim 1, wherein the curved safety structure is mounted to an edge of the transparent barrier.

11. The curved safety structure of claim 10, wherein the curved safety structure is mounted to the edge of the transparent barrier by at least one mechanical fastener.

12. The curved safety structure of claim 1, comprising a resilient element for impact absorption when the hockey player hits the curved safety structure.

13. The curved safety structure of claim 12, wherein the resilient element is compressed and allows movement of the curved outer surface when the hockey player hits the curved safety structure.

14. The curved safety structure of claim 13, wherein the resilient element comprises a spring.

15. The curved safety structure of claim 13, wherein the resilient element comprises foam.

16. The curved safety structure of claim 13, wherein the resilient element comprises an impact-absorbing bladder.

17. The curved safety structure of claim 12, wherein the resilient element is a resilient body and the curved outer surface is part of a curved layer secured over the resilient body.

18. The curved safety structure of claim 17, wherein the resilient body comprises a plurality of resilient body portions having different densities.

19. The curved safety structure of claim 18, wherein a first one of the resilient body portions is located closer to the curved outer surface and is less dense than a second one of the resilient body portions.

20. A facility for playing hockey comprising:

a. a hockey rink;

b. a transparent barrier above a board delimiting part of the hockey rink;

c. a player bench providing access to the hockey rink; and d. the curved safety structure of claim 1, the curved safety structure being mounted between the transparent barrier and the player bench.

21. The curved safety structure of claim 1, wherein the curved safety structure is connected to a free edge portion of the transparent barrier.

22. The curved safety structure of claim 1, wherein the curved safety structure is mounted in a gap between an edge of the transparent barrier and a part delimiting the player bench.

23. The curved safety structure of claim 22, wherein the part delimiting the player bench comprises a transparent guard.

24. The curved safety structure of claim 1, wherein the curved outer surface is configured to define a continuation of the transparent barrier.

25. The curved safety structure of claim 1, wherein at least a majority of the curved outer surface is disposed between the transparent barrier and a backside of the player bench.

26. The curved safety structure of claim 1, wherein at least a majority of the curved outer surface avoids projecting beyond the transparent barrier onto the hockey rink.

27. The curved safety structure of claim 1, wherein at least part of the curved safety structure is transparent to allow spectators to see the hockey rink through the curved safety structure.

28. A curved safety structure for protection of hockey players on a hockey rink, the curved safety structure being located between (i) a transparent barrier above a board delimiting part of the hockey rink and (ii) a player bench providing access to the hockey rink, the curved safety structure comprising:

a. a curved outer surface facing the hockey rink, at least part of the curved outer surface being convex and curving towards the player bench, the curved outer surface having a radius of curvature such that, when a hockey player impacts the curved outer surface during play on the hockey rink, the curved outer surface redirects the hockey player; and b. an inner surface opposite the curved outer surface.

29. The curved safety structure of claim 28 wherein the radius of curvature of the curved outer surface is at least six inches along at least part of the curved outer surface.

30. The curved safety structure of claim 29, wherein the radius of curvature of the curved outer surface is greater than six inches along at least part of the curved outer surface.

31. The curved safety structure of claim 28, wherein the radius of curvature of the curved outer surface is between six inches and twelve inches along at least part of the curved outer surface.

32. The curved safety structure of claim 28, wherein the radius of curvature of the curved outer surface is substantially constant across the curved outer surface.

33. The curved safety structure of claim 28, wherein the radius of curvature of the curved outer surface varies across the curved outer surface.

34. The curved safety structure of claim 28, wherein the curved outer surface comprises a material other than foam.

35. The curved safety structure of claim 28, wherein the curved outer surface comprises polycarbonate.

36. The curved safety structure of claim 35, wherein the polycarbonate comprises Lexan® polycarbonate.

37. The curved safety structure of claim 28, wherein the inner surface is a curved inner surface.

38. The curved safety structure of claim 37, wherein at least part of the curved inner surface is concave.

39. The curved safety structure of claim 28, wherein the curved safety structure is connectable to the transparent barrier.

40. The curved safety structure of claim 39, wherein the curved safety structure is connectable to an edge portion of the transparent barrier.

41. The curved safety structure of claim 40, wherein the curved safety structure is connectable to the edge portion of the transparent barrier by at least one mechanical fastener.

42. The curved safety structure of claim 28, comprising a resilient element for impact absorption when the hockey player hits the curved outer surface.

43. The curved safety structure of claim 42, wherein the resilient element is compressed and allows movement of the curved outer surface when the hockey player hits the curved outer surface.

44. The curved safety structure of claim 43, wherein the resilient element comprises a spring.

45. The curved safety structure of claim 43, wherein the resilient element comprises foam.

46. The curved safety structure of claim 43, wherein the resilient element comprises an impact-absorbing bladder.

47. The curved safety structure of claim 42, wherein the resilient element is a resilient body and the curved outer surface is part of a curved layer secured over the resilient body.

48. The curved safety structure of claim 47, wherein the resilient body comprises a plurality of resilient body portions having different densities.

49. The curved safety structure of claim 48, wherein a first one of the resilient body portions is located closer to the curved outer surface and is less dense than a second one of the resilient body portions.

50. The curved safety structure of claim 28, wherein at least part of the curved safety structure is transparent to allow spectators to see the hockey rink through the curved safety structure.

51. A facility for playing hockey comprising:

a. a hockey rink;

b. a transparent barrier above a board delimiting part of the hockey rink;

c. a player bench providing access to the hockey rink; and d. the curved safety structure of claim 28, the curved safety structure being located between the transparent barrier and the player bench.

52. The curved safety structure of claim 28, wherein the curved safety structure is located in a gap between an edge of the transparent barrier and a part delimiting the player bench.

53. The curved safety structure of claim 52, wherein the part delimiting the player bench comprises a transparent guard.

54. The curved safety structure of claim 28, wherein the curved outer surface is configured to define a continuation of the transparent barrier.

55. The curved safety structure of claim 28, wherein at least a majority of the curved outer surface is disposed between the transparent barrier and a backside of the player bench.

56. The curved safety structure of claim 28, wherein at least a majority of the curved outer surface avoids projecting beyond the transparent barrier onto the hockey rink.

* * * * *